US008533903B2

(12) United States Patent
Muhlenkamp et al.

(10) Patent No.: US 8,533,903 B2
(45) Date of Patent: Sep. 17, 2013

(54) DIRT CUP ASSEMBLY WITH A PRE-FILTER HAVING A PLURALITY OF RIBS

(75) Inventors: Eric E. Muhlenkamp, Lexington, KY (US); Joe M. Reynolds, Richmond, KY (US); Jeffrey T. Roney, Stanford, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 534 days.

(21) Appl. No.: 12/727,618

(22) Filed: Mar. 19, 2010

(65) Prior Publication Data

US 2011/0225764 A1 Sep. 22, 2011

(51) Int. Cl.
*A47L 9/10* (2006.01)
*A47L 9/20* (2006.01)
*B01D 45/00* (2006.01)

(52) U.S. Cl.
USPC ..... 15/352; 55/429; 55/DIG. 3

(58) Field of Classification Search
USPC ..... 15/350–353, 347; 55/345–349, 55/428, 429, 459.1, DIG. 3
See application file for complete search history.

(56) References Cited

U.S. PATENT DOCUMENTS

| | | | | |
|---|---|---|---|---|
| 5,137,554 | A | 8/1992 | Carter, Jr. | |
| 6,192,550 | B1 | 2/2001 | Hamada et al. | |
| 6,616,721 | B2 | 9/2003 | Oh | |
| 6,810,557 | B2 | 11/2004 | Hansen et al. | |
| 7,419,522 | B2 | 9/2008 | Arnold | |
| 7,640,624 | B2 | 1/2010 | Crouch et al. | |
| 2004/0074213 | A1 * | 4/2004 | Organ | 55/428 |
| 2006/0137303 | A1 | 6/2006 | Jeong et al. | |
| 2007/0266678 | A1 | 11/2007 | Makarov et al. | |
| 2009/0178237 | A1 * | 7/2009 | Proffitt et al. | 15/353 |

* cited by examiner

*Primary Examiner* — William Gilbert
(74) *Attorney, Agent, or Firm* — King & Schickli, PLLC

(57) ABSTRACT

A floor cleaning apparatus includes a housing having a nozzle assembly and a canister assembly. The nozzle assembly includes a suction inlet. Both a suction generator and a dirt collection assembly are carried on the housing. The dirt collection assembly includes a dirt cup, a shroud concentrically received within the dirt collection chamber defined by the dirt cup and at least one rib projecting from the shroud toward the bottom wall of the dirt cup. The rib is positioned so as to reduce air turbulence in the dirt collection chamber between an airflow guide on the shroud and the bottom wall of the dirt cup.

18 Claims, 6 Drawing Sheets

DIRT CUP ASSEMBLY WITH A PRE-FILTER HAVING A PLURALITY OF RIBS

TECHNICAL FIELD AND INDUSTRIAL APPLICABILITY OF THE INVENTION

This invention relates to the floor care equipment field and, more particularly, to a floor cleaning apparatus incorporating a dirt collection assembly including both ribs/vanes in the dirt collection chamber to reduce air turbulence and a dump door for easy and convenient emptying of the dirt cup.

BACKGROUND OF THE INVENTION

Upright and canister vacuum cleaners equipped with dirt collection assemblies comprising a dirt cup with a tangentially directed inlet and an axially directed outlet are well known in the art. Such a dirt cup provides for cyclonic air flow which utilizes centrifugal force to provide more efficient and effective cleaning of dirt and debris from the air stream.

After a certain period of use the dirt collection chamber in the dirt cup fills with debris and it becomes necessary to empty the dirt cup. Many operators do not enjoy handling the dirt cup and are uncomfortable during the emptying operation. Such operators typically want to minimize any potential contact with the dirt and debris held in the dirt cup. In order to address this concern, it is known in the art to provide a dirt cup with a hinged bottom wall or dump door as disclosed, for example, in U.S. Pat. No. 7,640,624 owned by the Assignee of the present invention. Advantageously, the dump door allows the operator to handle the dirt cup without opening the dirt compartment until the cup is positioned over a garbage can or other receptacle. The dump door is then opened and the dirt and debris in the dirt cup drops under the force of gravity into the underlying garbage receptacle. It should be appreciated that such a dirt cup with a dump door is user friendly, is considered generally more sanitary than other approaches and is a desirable feature.

As noted above, a cyclonic vacuum cleaner utilizes centrifugal force to help separate dirt and debris from the air stream. More specifically, the air stream enters the dirt cup through a tangentially directed inlet and flows rapidly in a cyclonic path around the cylindrical sidewall of the dirt cup. Dirt particles in the air stream move under the resulting centrifugal force produced by this cyclonic movement toward and against the cylindrical sidewall. There the particles slow due to the frictional contact with the sidewall and gradually drop toward the bottom of the dirt cup where they are collected.

It has been found that under certain operating conditions and in certain circumstances the air flow at the bottom of the dirt cup develops an elliptical component. At the same time the air stream typically maintains sufficient velocity to entrain some particles of dirt and debris. Thus, particle backflow may be produced where dirt and debris from the bottom of the cup is lifted back toward the top thereby reducing the overall cleaning efficiency of the vacuum cleaner.

In order to address this concern it is known to reduce turbulence in and particle backflow from the bottom of the dirt cup by positioning vanes or fins on the bottom wall or the outer cylindrical sidewall of the dirt cup as disclosed in, for example, U.S. Pat. Nos. 6,616,721 and 6,810,557. Positioning fins or vanes along the outer sidewall is not the most desirable solution since these vanes are in the path of particle concentration. As a result, the air stream and entrained particles impact the vanes with a high force. Often that force is sufficient to cause substantial airflow turbulence and particle scatter toward the center of the dirt cup where some of the particles have a tendency to be lifted toward the airstream outlet leading from the dirt collection chamber. This can adversely affect the cleaning efficiency of the vacuum cleaner.

While the positioning of the vanes or fins in the dirt cup along the bottom wall but spaced from the sidewall avoids this problem, such vanes are not compatible with a dirt cup with a hinged bottom wall or dump door. This is because these vanes would engage the sidewall of the dirt cup and prevent the bottom wall/dump door from opening completely thereby interfering with the dirt dumping or cup emptying operation.

The present invention relates to a vacuum cleaner incorporating a novel dirt collection assembly equipped with both a dump door and fins or vanes to reduce turbulence and particle back flow so as to allow more efficient cleaning operation. Thus, the present invention relates to the first floor cleaning apparatus to both incorporate and benefit fully from these two, previously incompatible features.

SUMMARY OF THE INVENTION

In accordance with the purposes of the invention as described herein, a floor cleaning apparatus is provided. That apparatus comprises a housing including a nozzle assembly and a canister assembly. The nozzle assembly includes a suction inlet. Both a suction generator and a dirt collection assembly are carried on the housing. The dirt collection assembly includes a dirt cup having a substantially cylindrical sidewall and a bottom wall defining a primary dirt collection chamber as well as a tangentially directed air stream inlet. In addition, the dirt collection assembly includes a shroud concentrically received within the sidewall in the dirt collection chamber. The shroud includes an air stream outlet, an air flow guide between the air stream outlet and the bottom wall and at least one rib or fin projecting from the shroud and, more particularly the air flow guide, toward the bottom wall. The at least one rib is positioned so as to reduce air turbulence in the dirt collection chamber between the air flow guide and the bottom wall.

Further describing the invention, a hinge is provided connecting the bottom wall to the sidewall of the dirt cup. A releasable latch mechanism secures the bottom wall to the side wall in a closed position so as to seal the dirt collection chamber during vacuum cleaner operation. When the dirt collection chamber fills with dirt and debris or the operator desires to empty dirt and debris from the dirt cup, the dirt cup is removed from the housing and positioned overlying a garbage receptacle. The latch mechanism is then released and the bottom wall or dump door swings open about the hinge and dirt and debris is emptied from the dirt cup into the underlying garbage receptacle under the force of gravity. Significantly, the ribs or fins for reducing turbulence do not in any way interfere with the hinged movement of the bottom wall or dump door.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Figure 1:
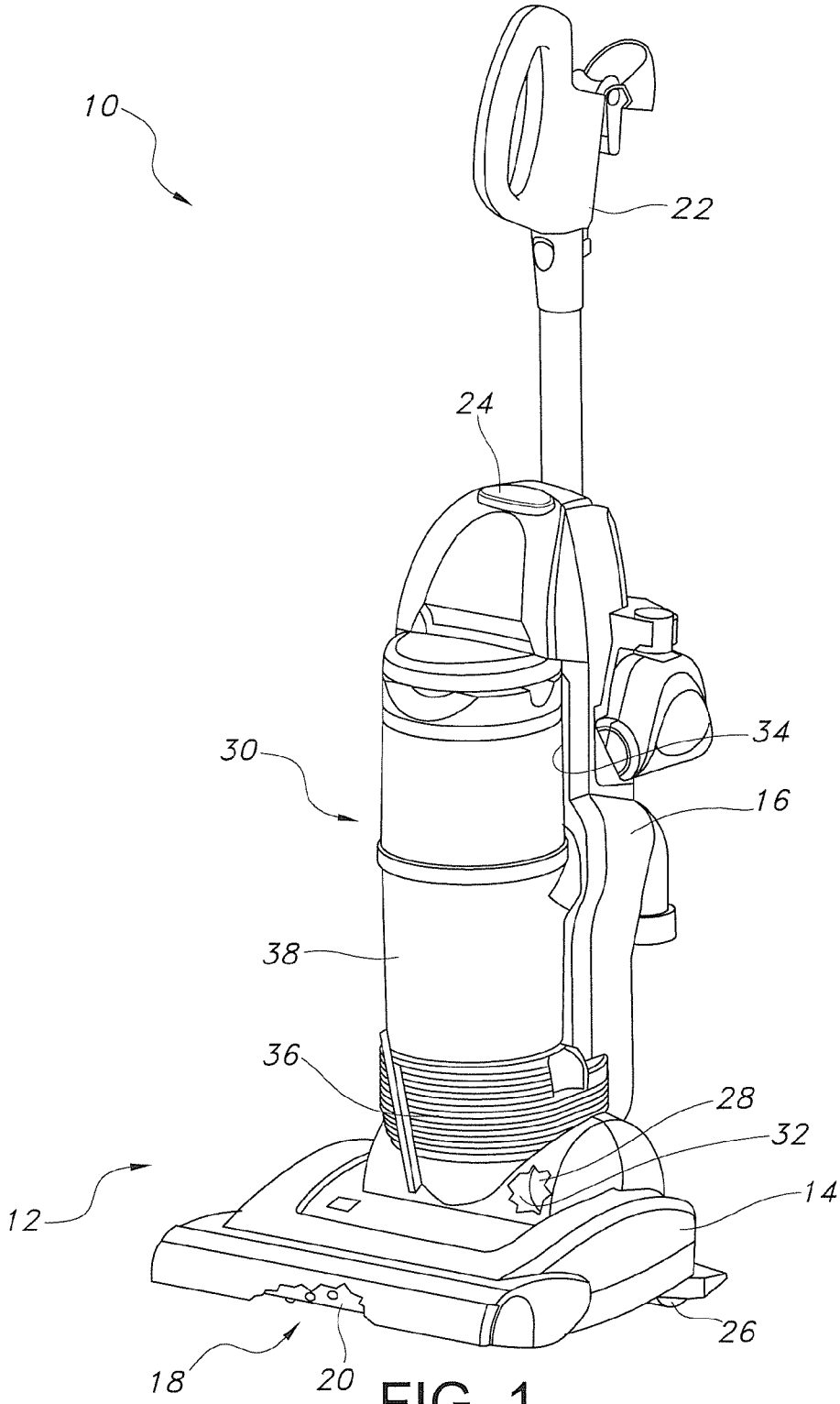
FIG. 1 is a perspective view of an upright vacuum cleaner constructed in accordance with the teachings of the present invention.

Reference is now made to FIG. 1 illustrating the floor care apparatus of the present invention in the form of an upright vacuum cleaner 10. The upright vacuum cleaner 10 has a housing 12 comprising a nozzle assembly 14 and a canister assembly 16. As is known in the art, the nozzle assembly 14 and canister assembly 16 are pivotally connected together. Further, the nozzle assembly includes a suction inlet 18. A rotary agitator 20 is mounted on the nozzle assembly 14 adjacent the suction inlet 18. The rotary agitator 20 may be equipped with bristles, tufts, wipers or other projecting cleaning structures (not shown) in a manner known in the art.

The canister assembly 16 includes an operating handle 22 by which the operator may control the movement of the vacuum cleaner 10 during the cleaning operation. A control switch 24 allows the operator to turn the vacuum cleaner on and off. Wheels 26 provided on the housing 12 allow the vacuum cleaner 10 to be moved smoothly across the floor. Both a suction generator 28, such as a fan and motor assembly, and a dirt collection assembly 30 are carried on the housing 12. In the illustrated embodiment the canister assembly 16 includes an internal compartment 32 for receiving the suction generator 28 and an opening 34 for receiving and holding the dirt collection assembly 30. Conduits, not shown, connect the suction inlet 18 with the dirt collection assembly 30 and the dirt collection assembly with the suction generator 28.

During vacuum cleaner operation, the operator manipulates the vacuum cleaner using the handle 22. Specifically, the operator pivots the canister assembly 16 relative to the nozzle assembly 14 so that the handle 22 moves from the storage position illustrated in FIG. 1 to an oblique, operating position. The operator is then able to move the vacuum cleaner 10 smoothly across the floor being cleaned as the canister assembly 16 freely pivots relative to the nozzle assembly 14.

During this movement, the rotary agitator 20 rotates at high speeds so as to brush and lift dirt and debris from an underlying carpet. That dirt and debris becomes entrained in the air stream being drawn into the suction inlet 18 of the vacuum cleaner 10 by the suction generator 28. The air stream with the entrained dirt and debris is then delivered to the dirt collection assembly 30 where dirt and debris are removed from the air stream and collected for later disposal. Clean air is then discharged from the dirt collection assembly 30 and drawn over the motor of the suction generator 28 so as to provide cooling. The air stream is then directed through a final filter (not shown) before being exhausted back into the environment through the exhaust port 36.

Figure 2:
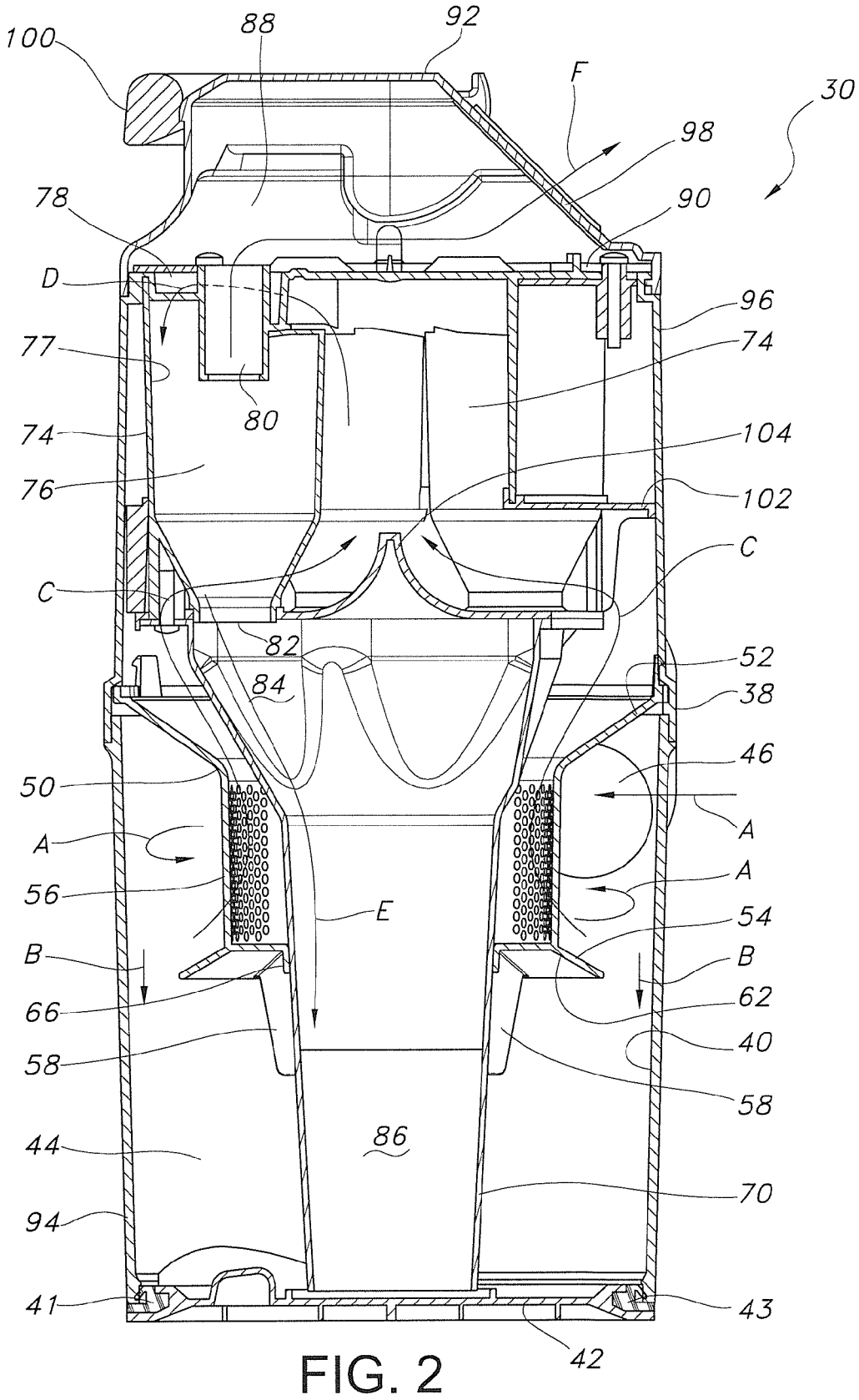
FIG. 2 is a detailed cross sectional view of the dirt collection assembly of the vacuum cleaner illustrating the bottom wall or dump door in the closed position.
Figure 3:
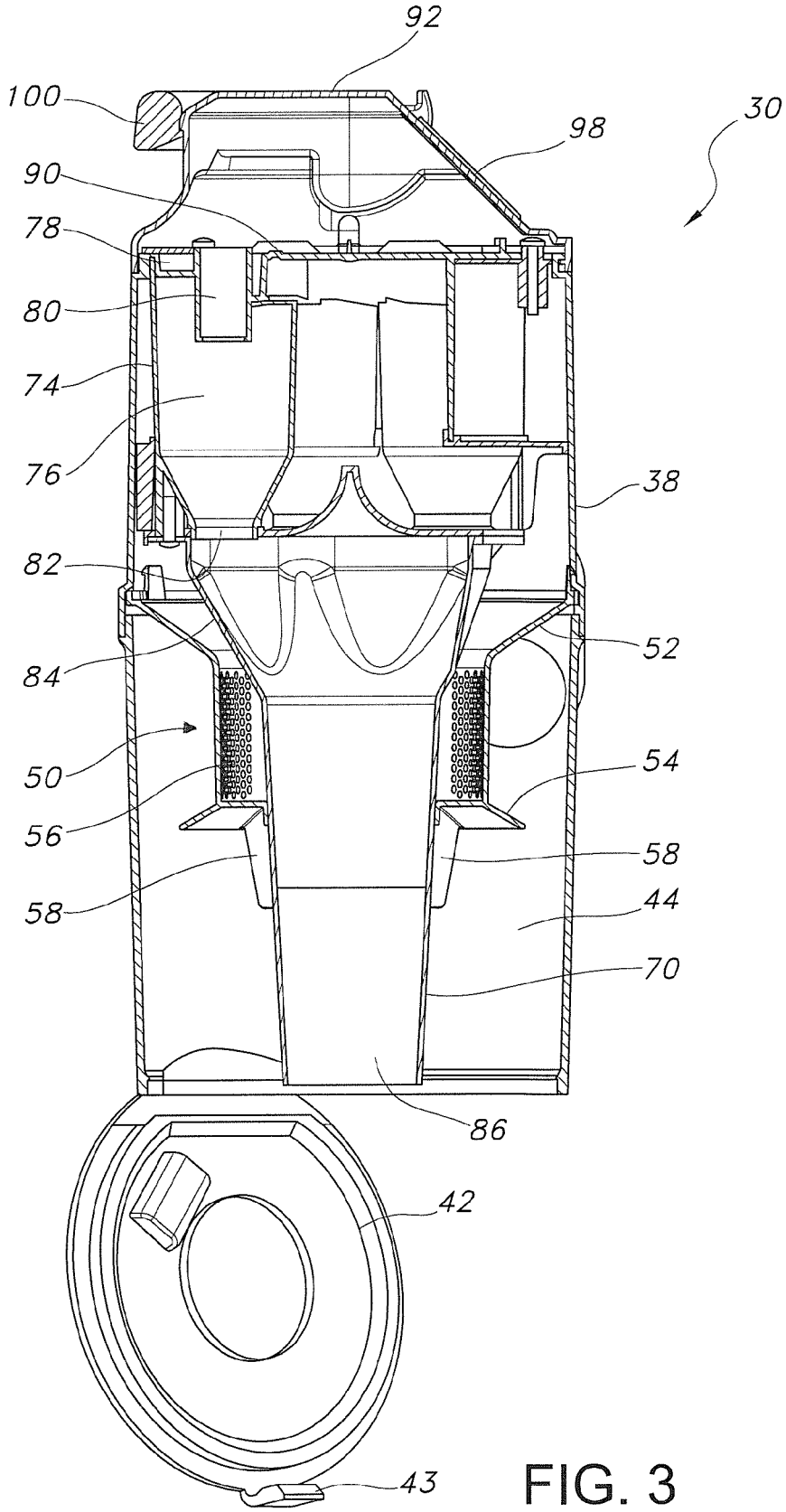
FIG. 3 is a view similar to FIG. 2 but illustrating the bottom wall or dump door in the open position so as to allow emptying dirt and debris from the dirt collection assembly.

Reference is now made to FIGS. 2 and 3 which illustrate the dirt collection assembly 30 of the present invention in detail. The dirt collection assembly 30 includes a dirt cup 38 having a substantially cylindrical sidewall 40 and a bottom wall 42 defining a primary dirt collection chamber 44. The bottom wall or dump door 42 is pivotally connected to the sidewall 40 by means of a hinge 41. A releasable latch mechanism 43, opposite the hinge 41, secures the bottom wall/dump door 42 in the closed position illustrated in FIG. 2 thereby sealing the dirt collection chamber 44. The latch mechanism 43 is released to open the bottom wall/dump door 42 and allow emptying of dirt and debris from the dirt cup 38 under the force of gravity. Air entrained with dirt and debris is delivered to the primary dirt collection chamber 44 through a tangentially directed air stream inlet 46 provided in the sidewall 40.

Figure 4:
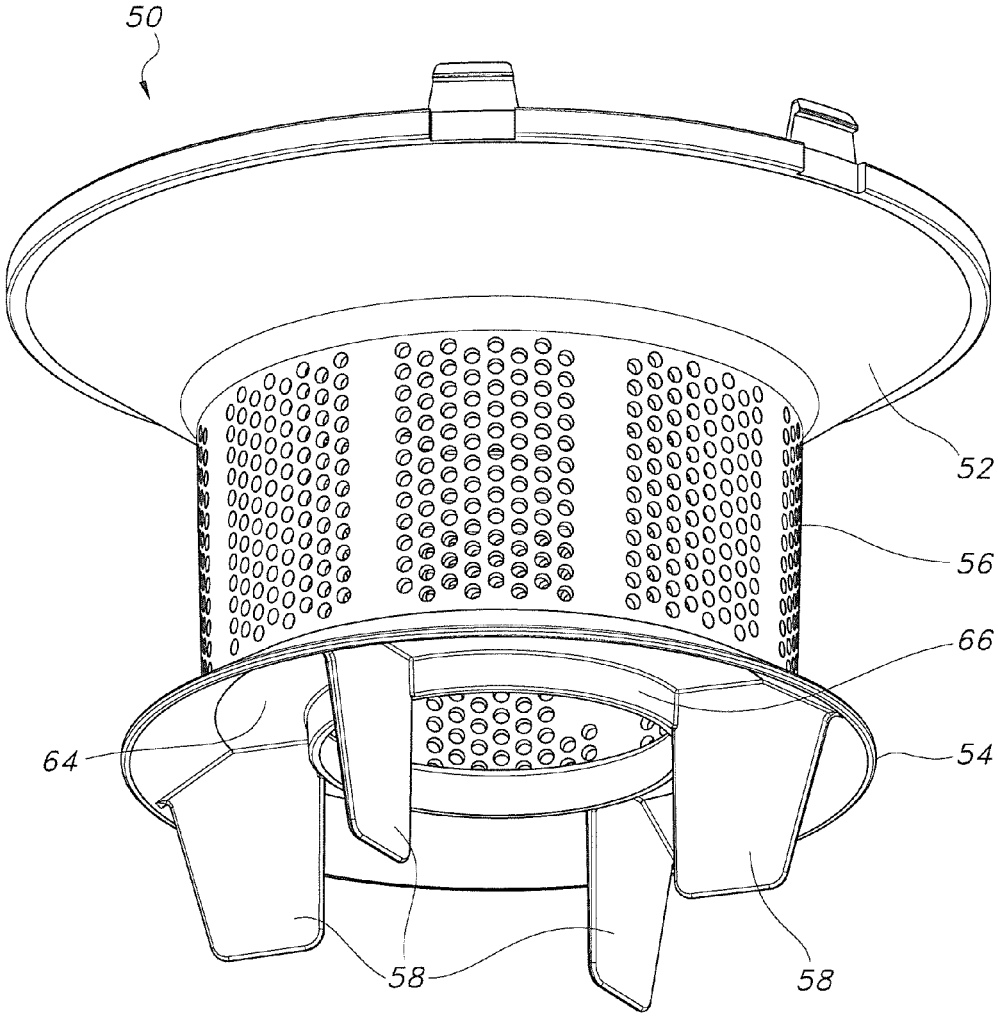
FIG. 4 is a detailed perspective view of a portion of the shroud that is concentrically received within the dirt collection chamber and clearly illustrating the airflow guide and the projecting ribs or fins that reduce air turbulence in the dirt collection chamber.
Figure 5:
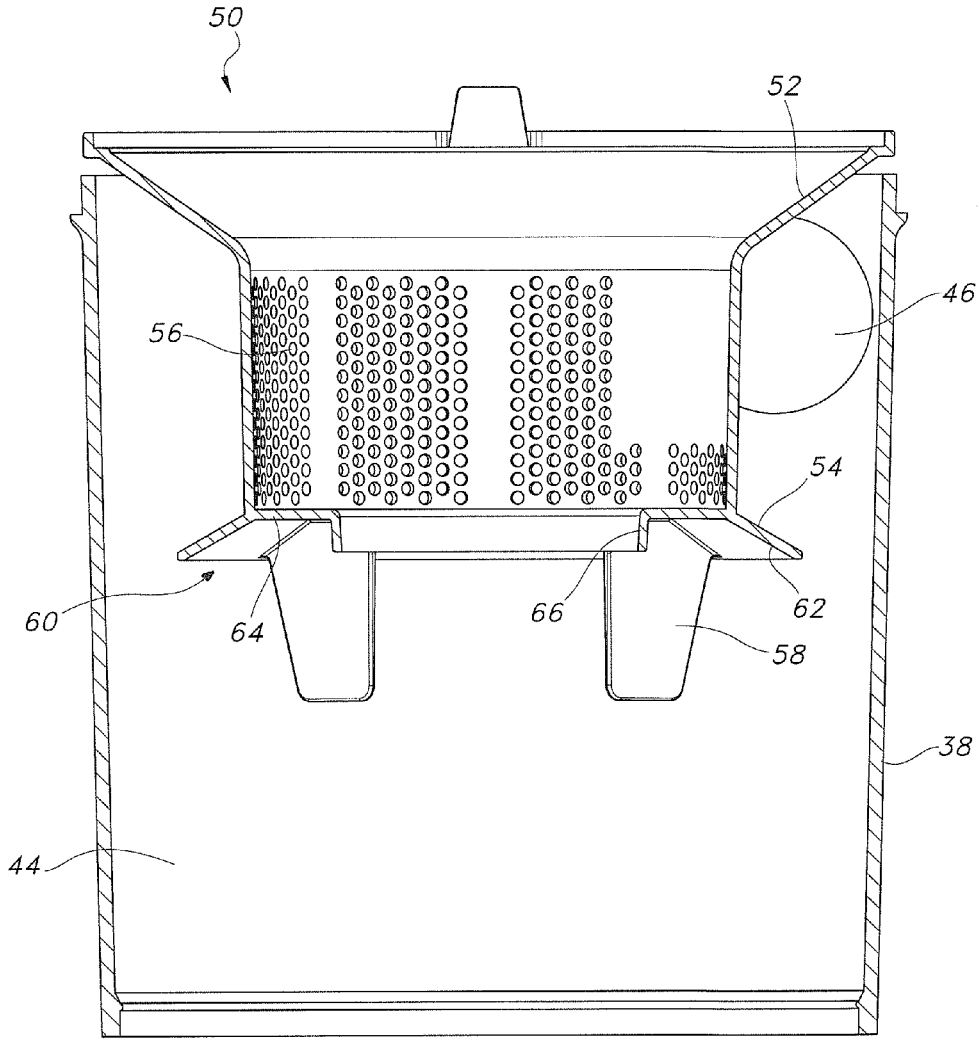
FIG. 5 is a detailed cross sectional view of the shroud showing the channel underlying the air flow guide.

A shroud 50 is concentrically received within the sidewall 40 in the dirt collection chamber 44. The shroud 50 includes a partition 52, an airflow guide 54, a sieve section 56 provided between the partition 52 and airflow guide 54 and multiple ribs, fins or vanes 58 (four are illustrated) projecting from the airflow guide 54 (see also FIG. 4). The partition 52 of the shroud 50 abuts and seals against the cylindrical sidewall 40 of the dirt cup 38 thereby forming the top wall of the dirt collection chamber 44. The sieve section 56 of the shroud 50 includes multiple apertures that define the air stream outlet of the dirt collection chamber 44. Here it should be appreciated that the primary dirt collection chamber 44 defined by the cylindrical sidewall 40, bottom wall 42 and shroud 50 functions as the primary separation stage of the dirt collection assembly 30.

As illustrated in FIGS. 2-5, the airflow guide 54 is an annular, disc-shaped projection. A channel 60 is formed by the lower surface 62 of the air flow guide 54, the bottom wall 64 and the depending lip 66 of the shroud 50. The channel 60 functions to redirect any rising air currents adjacent the ribs 58 downwardly and outwardly so as to maintain debris and dirt particles in the bottom section of the dirt cup 38 below the air flow guide 54 and away from the sieve section 56.

Each rib or vane 58 depending from the air flow guide 54 is tapered from a proximal end adjacent the air flow guide 54 to a distal end away from the air flow guide 54. Further, the distal end of each rib/vane 58 includes rounded corners which aid in reducing turbulence. While the ribs/vanes 58 of the illustrated embodiment are all the same size and shape, it should be appreciated that the ribs/vanes may have different shapes and/or be of different sizes.

The shroud 50 also includes a tubular, cylindrical or slightly tapering support 70 that is connected to the depending lip 66. The bottom edge 72 of the support 70 abuts the bottom wall 42 of the dirt cup 38. A plurality of secondary cyclones 74 are provided in a second section of the dirt cup 38 on the side of the partition 52 opposite the dirt collection chamber 44. Each secondary cyclone 74 includes a vortex chamber 76 having a cylindrical sidewall 77, a tangentially oriented or directed inlet 78, an axially directed clean air discharge outlet 80 and a fine particle discharge outlet 82. As should be appreciated, the clean air discharge outlet 80 is at a first end while the fine particle discharge outlet 82 is provided at a second opposite end. Fine particles are discharged from each secondary cyclone 74 through the fine particle discharge 82 into an underlying conduit 84 with converging sidewalls. The particles travel through the conduit 84 to a secondary dirt collection chamber 86 formed within the cylindrical support 70. Simultaneously, clean air stripped of the fine dust particles travels axially through the clean air discharge outlet 80 into a clean air manifold 88 formed between the partition 90 and a lid 92 that closes the open end or top of the dirt cup 38. Here it should be appreciated that the dirt cup 38 may be formed by two sections 94, 96 that are joined together adjacent the partition 52. The lid 92 includes an outlet port 98 that is connected by a conduit (not shown) to the intake or suction side of the suction generator 28. The lid 92 also includes a handle 100 that is pivotally connected to the lid and allows one to conveniently hold and carry the dirt collection assembly 30 when it is removed from the opening 34 of the canister assembly 16 for emptying or any other purpose.

During operation, the rotary agitator 20 brushes the nap of an underlying carpet so as to loosen dirt and debris. That dirt and debris is then entrained in the airstream being drawn into the vacuum cleaner 10 by the suction generator 28. The airstream with entrained dirt and debris is then delivered vie a conduit (not shown) to the tangentially directed inlet 46 of the dirt collection assembly 30. The airstream then enters the primary dirt collection chamber 44 moving around the cylindrical sidewall 40 in a cyclonic path (note action arrows A in FIG. 2). As a result, dirt and debris entrained in that airstream moves under the influence of centrifugal force toward and against the sidewall 40. As the dirt and debris slows under the frictional forces produced by contact with the sidewall 40, the dirt and debris falls through the gap G between the airflow guide 54 and the sidewall 40 toward the bottom wall 42 of the dirt cup 38 (see action arrows B in FIG. 2). Dirt and debris collects in the bottom of the dirt cup 38 adjacent the bottom wall 42. Advantageously, the ribs/vanes 58 depending downwardly from the airflow guide 54 along the lip 66 and support 70 of the shroud 50 reduce the air turbulence in the bottom of the dirt cup 38 below the airflow guide 54. Further, any rising air currents are redirected by the channel 62 below the airflow guide 54 back toward the sidewall 40 and the downwardly directed air currents identified by action arrows B. Together the ribs/vanes 58 and the channel 62 formed by the airflow guide 54 function to maintain dirt and debris in the bottom of the dirt cup so as to enhance cleaning efficiency.

While dirt and debris are deflected by the channel 62 back toward the bottom wall 42 of the dirt cup 38, relatively clean air flows around the outer edge of the airflow guide 54 toward the sieve section 56. That clean air travels through the plurality of apertures in the sieve section 56 up along the outer surface of the conduit 84 toward the partition 102 (see action arrows C in FIG. 2). The airstream then travels around the lower, truncated cone portions of the secondary cyclones 74 and is redirected by the air deflector 104 upwardly between the secondary cyclones 74 to the tangentially oriented or directed inlets 78 by which the airstream enters the secondary cyclones 74 (see action arrow D in FIG. 2).

As the airstream enters the vortex chambers 76 of each secondary cyclone 74 it swirls in a cyclonic path around the cylindrical sidewall 77 so that any remaining fine dust particles are moved toward and through the fine particle discharge outlets 82. The particles then fall through the conduit 84 into the secondary dirt collection chamber 86 inside the support 70 where they are maintained and collected (see action arrow E in FIG. 2). Simultaneously, clean air now devoid of those fine particles travels through the axially directed clean air discharge outlet 80 of each secondary cyclone 74 into the clean air manifold 88 before passing through the outlet port 98 (note action arrows F in FIG. 2). From there, the clean air travels through a conduit (not shown) to the intake or suction side of the suction generator 28. The airstream then travels over the motor of the suction generator 28 to provide cooling. Next the airstream passes through a final filter to remove any remaining dust particles and carbon scavenged from the brushes of the motor before being exhausted through the exhaust port 36 back into the environment.

The operator can quickly and conveniently empty the dirt collection assembly. Specifically, the operator lifts the handle 100 to release the dirt collection assembly 30 from the opening 34 in the canister assembly 16. The operator then carries the dirt collection assembly 30 by means of the handle 100 to a garbage receptacle. While holding the dirt collection assembly 30 over the garbage receptacle, the operator releases the latch 43. Gravity then causes the bottom wall or dump door 42 to swing completely open about the hinge 41 and dirt and debris falls from the dirt cup 38. More specifically, dirt and debris from both the primary dirt collection chamber 44 and the secondary dirt collection chamber 86 fall into the underlying garbage receptacle. Advantageously, there is no need to open the dirt cup 38 and expose the dirt contained therein to the environment until the operator is actually ready to empty the dirt cup into the garbage receptacle. Further, there is no need for the operator to come into direct contact with the dirt in the receptacle. In addition, it should be appreciated that while the dirt collection assembly 30 incorporates a series of ribs or vanes 58 that reduce turbulence in the dirt cup and increase cleaning efficiency, these ribs or vanes 58 are positioned so as to not interfere with the smooth operation of the dump door 42. Accordingly, the clump door 42 fully opens to allow easy and convenient emptying of the dirt cup as desired.

After emptying the dirt cup, the operator closes the bottom wall/dump door 42 by pivoting about the hinge 41. The resilient latch mechanism 43 functions to once again lock the bottom wall/dump door 42 in the closed position once the wall/door is properly seated against the sidewall 40. The operator then replaces the dirt collection assembly 30 back in the opening 34 provided in the canister assembly 16 where it seats thereby placing the vacuum cleaner 10 in condition for operation.

The foregoing description of the preferred embodiments of the present invention have been presented for purposes of illustration and description. It is not intended to be exhaustive or to limit the invention to the precise form disclosed. Obvious modifications or variations are possible in light of the above teachings. The ribs/vanes 58 could be secured to another portion of the shroud 50 instead of the air flow guide 54. For example, the ribs/vanes 58 could be secured to the support 70 which is secured to the lip 66 and remains within the dirt collection chamber 44 when the bottom wall/dump door 42 is opened (see FIG. 3).

Figure 6:
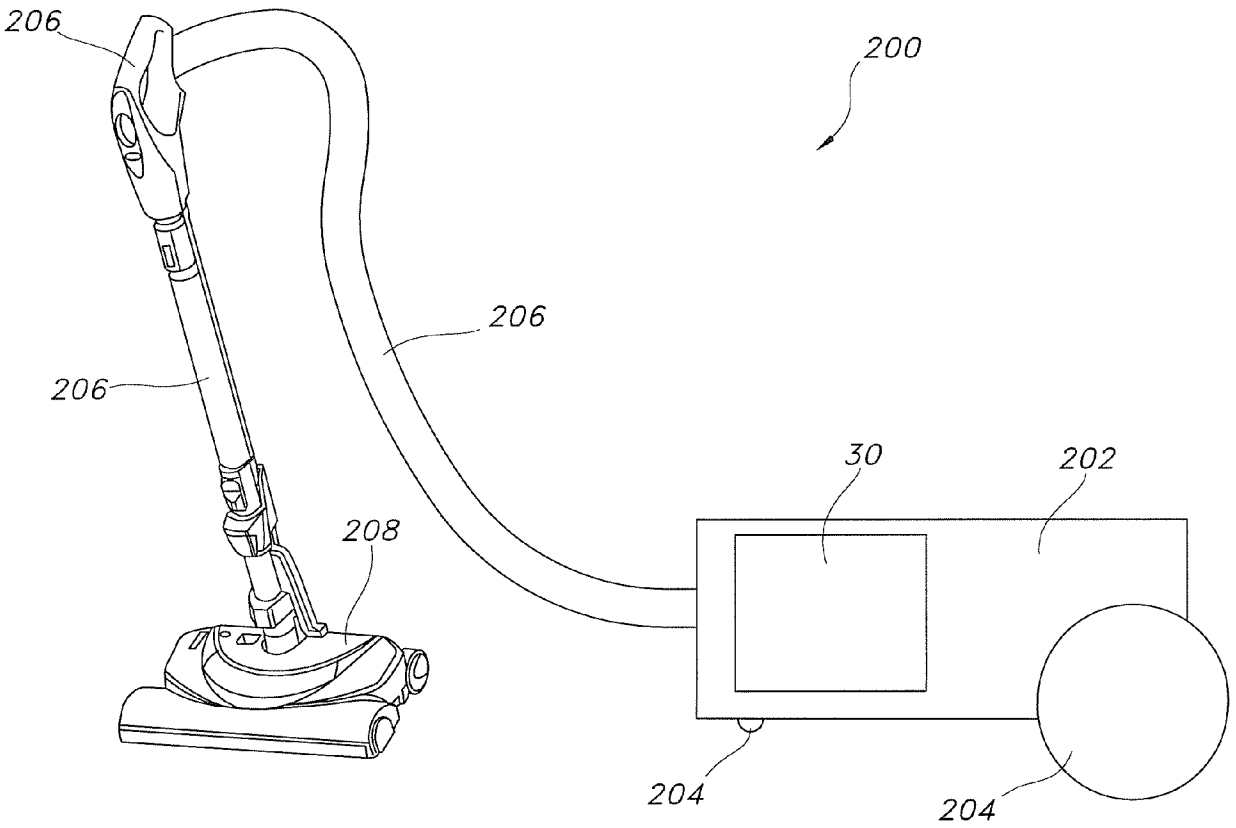
FIG. 6 is a schematical illustration of a canister vacuum cleaner constructed in accordance with the teachings of the present invention.

As illustrated in FIG. 6, the invention is not limited to an upright vacuum cleaner 10 as shown in FIG. 1. The canister vacuum cleaner 200 of FIG. 6 includes a canister body 202 supported on wheels 204. The dirt collection assembly 30 of the present invention as described above is carried on the canister body. A wand and hose assembly 206 connects the canister body 202 to the nozzle assembly 208.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A floor cleaning apparatus, comprising:

a housing including a nozzle assembly and a canister assembly, said nozzle assembly including a suction inlet;

a suction generator carried on said housing; and a dirt collection assembly carried on said housing;

said dirt collection assembly including:

(a) a dirt cup having a substantially cylindrical sidewall and a bottom wall defining a primary dirt collection chamber as well as a tangentially directed airstream inlet;

(b) a shroud concentrically received within said sidewall in said dirt collection chamber, said shroud including an airstream outlet and an air flow guide between said airstream outlet and said bottom wall, said air flow guide projecting outwardly toward said cylindrical sidewall; and (c) at least one rib projecting out of a channel from a lower surface of said airflow guide only partially toward said bottom wall so as to provide an open space between a lowermost surface of said at least one rib and said bottom wall, said at least one rib being positioned so as to reduce air turbulence in said dirt collection chamber between said air flow guide and said bottom wall.

2. The apparatus of claim 1, further including a hinge connecting said bottom wall to said sidewall and a releasable latch mechanism securing said bottom wall to said sidewall in a closed position so as to seal said dirt collection chamber.

3. The apparatus of claim 1, wherein said shroud includes a sieve section that defines said airstream outlet, said sieve section being provided on a first side of said air flow guide while said at least one rib is provided on a second, opposite side of said air flow guide.

4. The apparatus of claim 1, wherein said at least one rib is tapered from a proximal end adjacent said air flow guide to a distal end away from said airflow guide.

5. The apparatus of claim 4, wherein said distal end of said at least one rib has rounded corners.

6. The apparatus of claim 1, wherein four ribs are provided.

7. The apparatus of claim 1, wherein said shroud has (a) a partition that engages said sidewall and defines a top wall of said primary dirt collection chamber and (b) a support concentrically received in said primary dirt collection chamber and engaging said bottom wall.

8. The apparatus of claim 7, further including a plurality of secondary cyclones in said dirt cup on a side of said partition opposite said primary dirt collection chamber, said plurality of secondary cyclones receiving said airstream passing through said airstream outlet and removing fine particles from said airstream before discharging said airstream toward said suction generator.

9. The apparatus of claim 8, wherein each of said plurality of secondary cyclones includes a fine particle discharge outlet for discharging fine particles separated from said air stream by said secondary cyclone toward a secondary dirt collection chamber in said cylindrical support.

10. The apparatus of claim 9, wherein each of said plurality of secondary cyclones includes a cylindrical sidewall, a tangentially oriented inlet and a clean air discharge outlet.

11. The apparatus of claim 10, wherein said clean air discharge outlet is axially oriented within each of said plurality of secondary cyclones.

12. The apparatus of claim 11, wherein said clean air discharge outlet is provided at a first end and said fine particle discharge outlet is provided at a second, opposite end of each of said plurality of secondary cyclones.

13. The apparatus of claim 9, wherein said dirt cup includes a first section and a second section, said first and second sections of said dirt cup joining together adjacent said partition.

14. The apparatus of claim 13, wherein said floor cleaning apparatus is an upright vacuum cleaner wherein said nozzle assembly is pivotally connected to said canister assembly.

15. The apparatus of claim 13, wherein said floor cleaning apparatus is a canister vacuum cleaner wherein a hose and wand assembly connects said nozzle assembly to said canister assembly.

16. The apparatus of claim 13, further including a lid engaging an open end of said second section of said dirt cup and closing a top of said dirt cup.

17. The apparatus of claim 16, further including a handle connected to said lid.

18. The apparatus of claim 1 wherein said shroud further includes a depending lip, said at least one rib extending radially outwardly from said depending lip and downwardly from said channel toward said bottom wall.

* * * * *